US006050845A

United States Patent [19]

Smalley, Jr. et al.

[11] Patent Number: 6,050,845

[45] Date of Patent: Apr. 18, 2000

[54] ELECTRICAL CONNECTOR FOR TERMINATING INSULATED CONDUCTORS

[75] Inventors: Jared Joseph Smalley, Jr., Harrisburg; John A. Root, Middletown; John Lawrence Broschard, III, Hershey, all of Pa.

[73] Assignee: The Whitaker Corporation, Wilmington, Del.

[21] Appl. No.: 09/196,404

[22] Filed: Nov. 19, 1998

Related U.S. Application Data

[60] Provisional application No. 60/066,247, Nov. 20, 1997.

[51] Int. Cl.[7] ..... H01R 4/24

[52] U.S. Cl. ..... 439/417; 439/677; 439/395

[58] Field of Search ..... 439/417, 404, 439/395, 409, 410, 674, 677, 678, 679, 680, 79

[56] References Cited

U.S. PATENT DOCUMENTS

| | | | |
|---|---|---|---|
| 2,745,065 | 5/1956 | Maher | 439/411 |
| 4,192,570 | 3/1980 | Van Horn | 439/402 |
| 4,217,022 | 8/1980 | Carré | 439/404 |
| 4,781,618 | 11/1988 | Geib et al. | 439/417 |
| 5,190,470 | 3/1993 | Soes et al. | 439/417 |
| 5,490,787 | 2/1996 | Bowman et al. | 439/79 |
| 5,520,550 | 5/1996 | Okabe | 439/404 |
| 5,540,598 | 7/1996 | Davis | 439/79 |
| 5,549,484 | 8/1996 | Chen | 439/417 |
| 5,551,889 | 9/1996 | Kozel et al. | 439/404 |
| 5,573,421 | 11/1996 | Reichle | 439/409 |
| 5,713,767 | 2/1998 | Hanson et al. | 439/853 |
| 5,785,548 | 7/1998 | Capper et al. | 439/409 |

*Primary Examiner*—Paula Bradley
*Assistant Examiner*—Tho D. Ta

[57] ABSTRACT

An electrical connector (10) includes a housing (12) having at least one conductor-receiving aperture (16) and an associated terminal-receiving passageway (32) intersecting each conductor-receiving aperture (16), and a terminal (40) disposed in each terminalreceiving passageway (32). Each terminal (40) includes a body (42) having a first connecting section (44) extending from one end thereof and a pair of upstanding arms (46) defining an insulation displacement contact at an opposite end. Each terminal (40) is partially inserted into the terminal-receiving passageway (32) in a first position and upon positioning the first connecting sections (44) in corresponding through-holes (62) of a circuit board (60), the terminals (40) can be secured to the board (60). The ends of insulated conductors (70) then can be inserted into respective conductor-receiving apertures (16) and terminated to respective terminals (40) therein by moving the housing (12) toward the board (60) to a second position against the board (60).

16 Claims, 5 Drawing Sheets

ELECTRICAL CONNECTOR FOR TERMINATING INSULATED CONDUCTORS

This application claims benefit of Provisional Application No. 60/066,247 filed Nov. 20, 1997.

FIELD OF THE INVENTION

This invention is directed to electrical connectors and more particularly to connectors having terminals with insulation displacement terminations.

BACKGROUND OF THE INVENTION

For purposes of illustrating the invention, the connector will be described with reference to connecting a power cord to a circuit board of an electronic apparatus, such as, for example, a television, a radio, a household appliance or the like. A common way of making such terminations is to hard wire the cord, that is, to strip the ends of the conductors in the cord and solder the exposed wires directly to conductive pads on the circuit board. This process is labor intensive and the resulting soldered connection must be carefully inspected to assure that the wires are securely fastened to the circuit board. It is desirable, therefore, to have a more cost effective manufacturing process that eliminates the need for hand assembly.

U.S. Pat. No. 5,551,899 discloses a wire to board connector having a first housing with board mountable terminals therein and a second housing having conductor-receiving apertures therein used to stuff wires into the terminals.

SUMMARY OF THE INVENTION

The present invention is directed to an electrical connector that can be mounted to a circuit board and secured thereto prior to terminating conductors to the connector. The electrical connector includes a housing having at least one conductor-receiving aperture extending thereinto from a conductor-receiving face and an associated terminal-receiving passageway extending thereinto from a board mounting face and intersecting each conductor-receiving aperture, and a terminal disposed in each terminal-receiving passageway. Each terminal includes a body portion having a first connecting section extending from one end thereof adapted to be inserted in a through-hole of a circuit board and a pair of upstanding arms defining an insulation displacement contact at an opposite end thereof for terminating an insulated conductor upon receipt thereof into an IDC slot between the arms. Each terminal is partially inserted into the housing in a first position such that a portion of the terminal body and the first connecting section extends below the board mounting face of the housing. Upon positioning the first connecting sections in corresponding through-holes of a circuit board, the terminals can be secured to the board, after which ends of insulated conductors can be inserted into respective conductor-receiving apertures and terminated therein to respective terminals by moving the housing toward the bcard to a second position against the board and simultaneously pushing all the corresponding wires into respective IDC slots. For purposes of illustration, the invention is shown as a two position connector.

In the embodiment, as shown, the board mounting face also includes a board mounting-locking post that holds the connector to the board in its first position by means of an interference fit in a cooperating aperture in the board. Upon moving the connector to its second position, the board lock extends through the board and a portion thereof locks under the board.

Additionally, the board mounting face may also include a pair of alignment posts and a board lock post, all of which extend below the board mounting face a slight distance beyond the board mounting portions of the terminals such that the housing can be aligned to the board prior to inserting the terminals into the through-holes.

An embodiment of the invention will now be described by way of example with reference to the accompanying drawings.

DETAILED DESCRIPTION OF AN EMBODIMENT OF THE INVENTION

For purposes of illustrating the invention the connector 10 is shown as a two position connector for terminating conductors of a power cord or the like. Connector 10 includes a housing 12 and a pair of substantially flat terminals 40 disposed therein. It is to be understood that the connector may have additional terminal positions therein when required.

Figure 1:
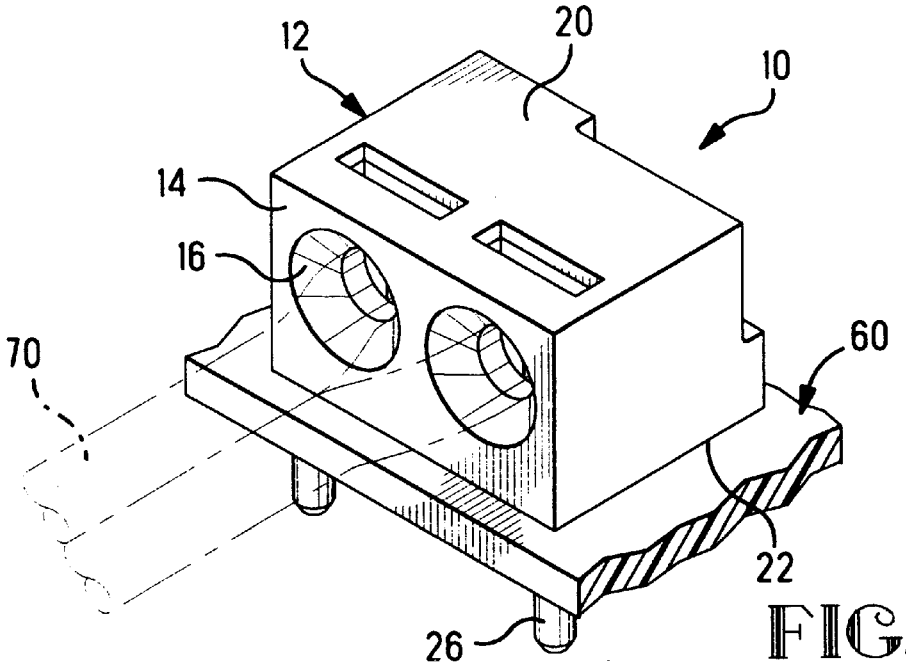
FIG. 1 is an isometric view of the assembled connector of the present invention mounted to a circuit board with the conductors terminated therein shown in phantom.
Figure 4:
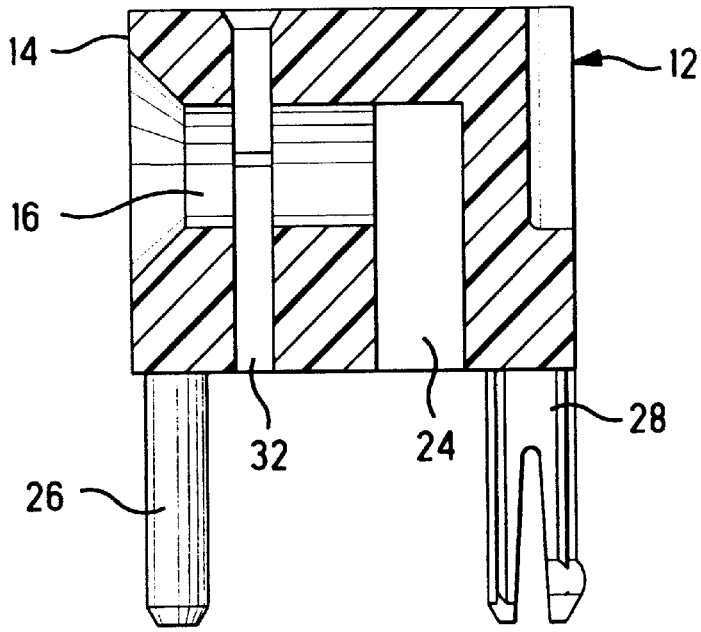
FIG. 4 is a sectional view of the internal structure of the connector housing.
Figure 2:
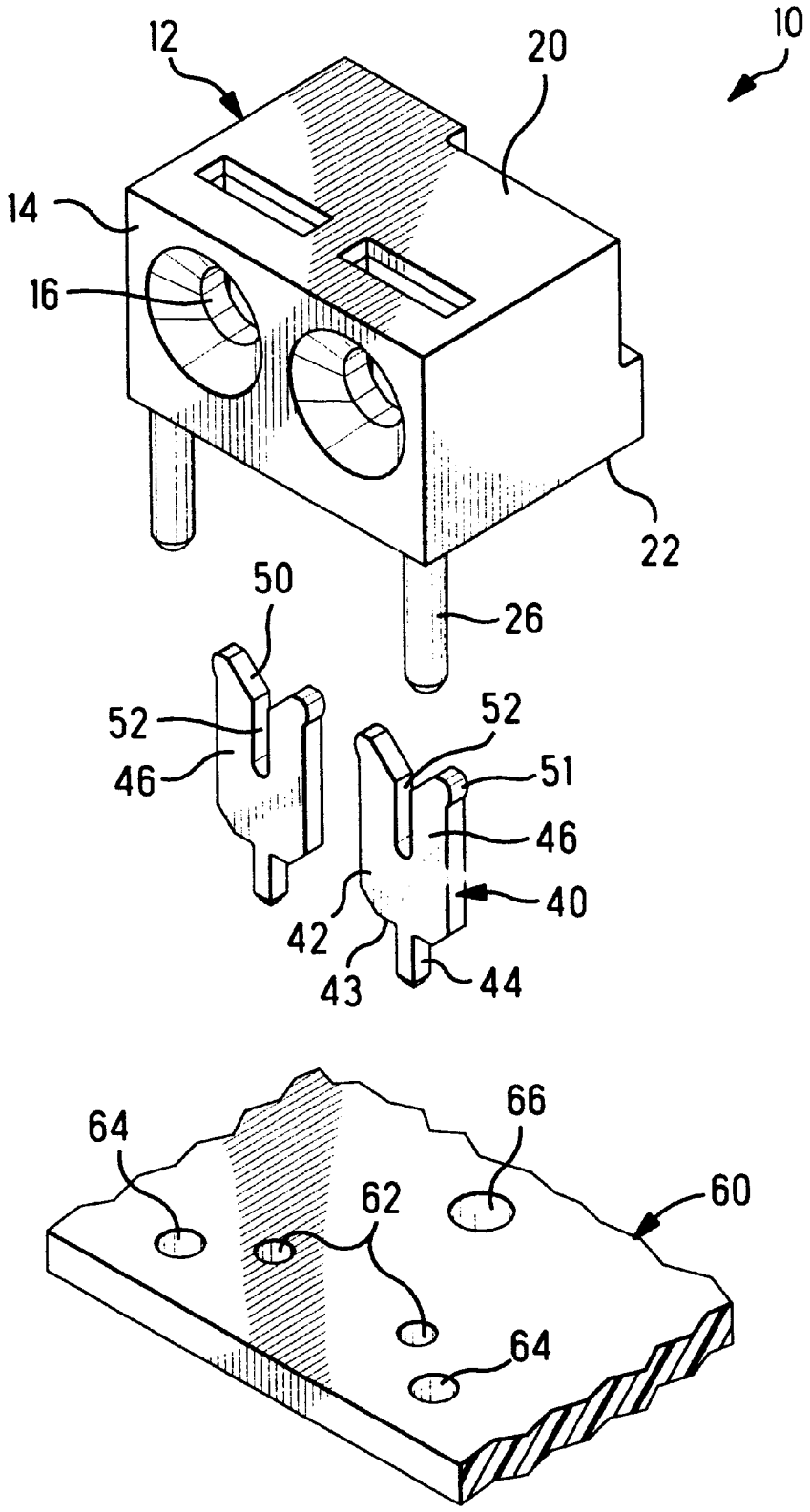
FIG. 2 is an exploded view of the connector of FIG. 1 as viewed from the front thereof.
Figure 3:
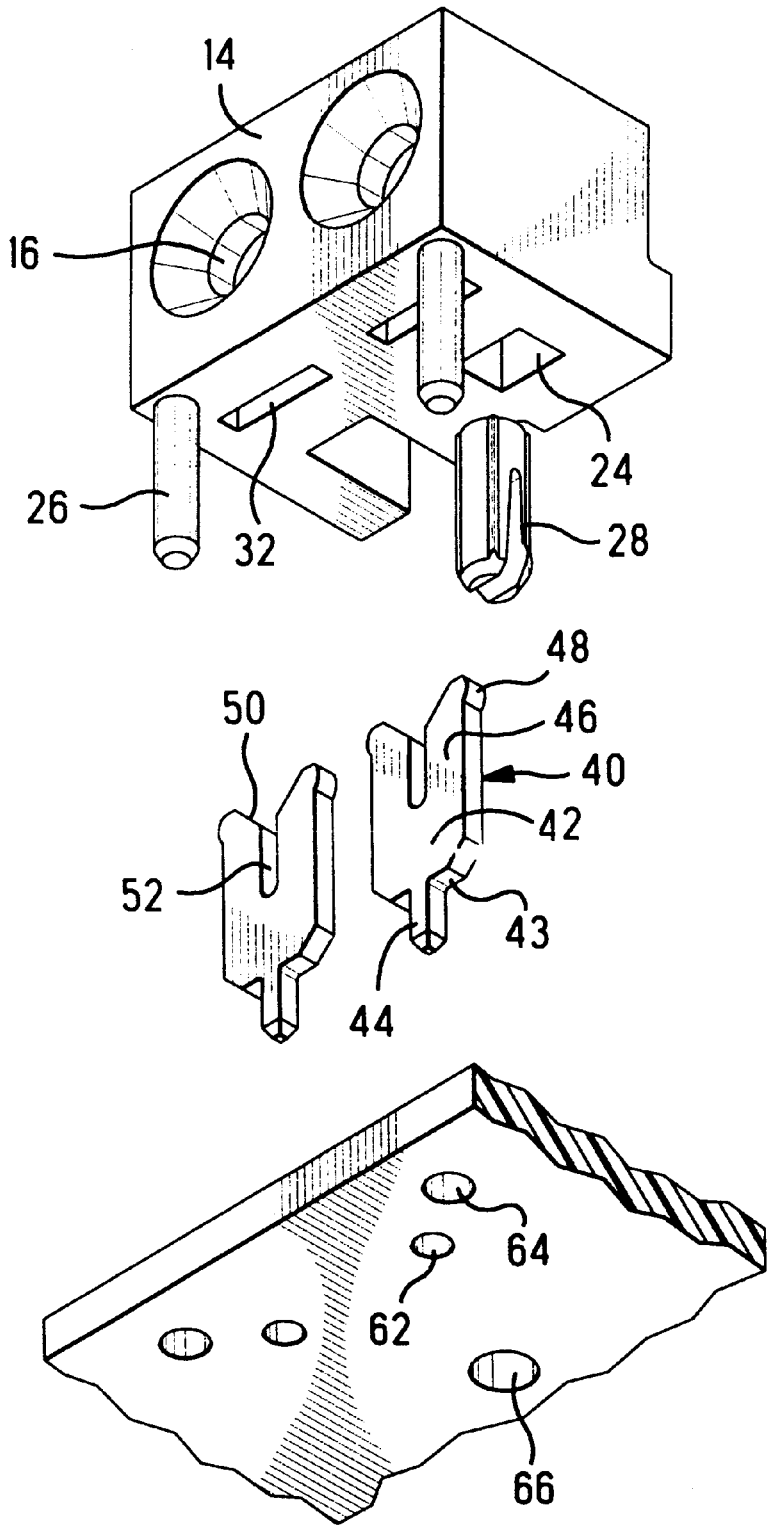
FIG. 3 is an exploded view of the connector of FIG. 1 as viewed from the board mounting surface thereof.

Referring now to FIGS. 1 through 8, connector housing 12 has a conductor-receiving face 14, top surface 20, and a board mounting face 22. The connector housing 12 includes a pair of conductor-receiving passageways 16 extending inwardly from the front face 14 thereof. Housing 12 further includes a pair of terminal-receiving passageways 32 extending from the board mounting surface 22 toward the top surface 20 and are in communication with the conductor-receiving passageways 16, as best seen in FIG. 4. FIG. 4 illustrates the structure of the housing 12 wherein the conductor-receiving passageways 16 extend in and beyond the terminal-receiving passageways 32. The housing further includes openings 24 which extend toward the top face 20 ending at the upper surface of the conductor-receiving passageway 16 thereby providing additional clearance of the ends of the conductors 70 to assure that the conductors 70 are completely positioned in the passageways 16. The board mounting face 22 includes a pair of alignment posts 26 and a board locking post 28 adapted to be received in corresponding apertures 64 and 66 of a circuit board 60.

Terminals 40 are stamped numbers having a body 42 having a first connecting or board mounting portion 44 extending from one side of body 42 and a pair of arms 46 defining an IDC connecting slot 52 extending in an opposite direction therefrom. Arms 46 extend upwardly from the body 42 to leading ends 48 having a tapered lead-in portion 50 thereon to guide conductors 70 into respective slots 52. For purposes of illustration, the board mounting portions 44 are shown as solder tails. It is to be understood that the board mounting portions may be surface mountable instead.

In the initial assembly position the terminals 40 are inserted into respective terminal-receiving apertures 32 such that outside edges of the terminals 40 are received in an interference fit within the passageways 32 with protrusions 51 of the terminals engaging the inner surfaces 34 of the respective passageways 32 to hold the terminals in the housing 12. The terminals 40 are held with sufficient force in the passageway such that the connector 10 can be shipped to the circuit board or appliance assembler.

Figure 5:
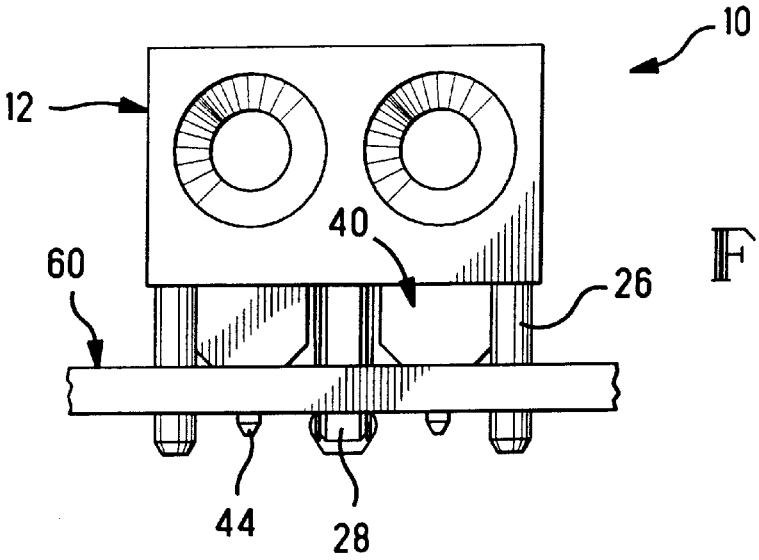
FIG. 5 is a front plan view of the connector with the terminals inserted in their first position.
Figure 6:
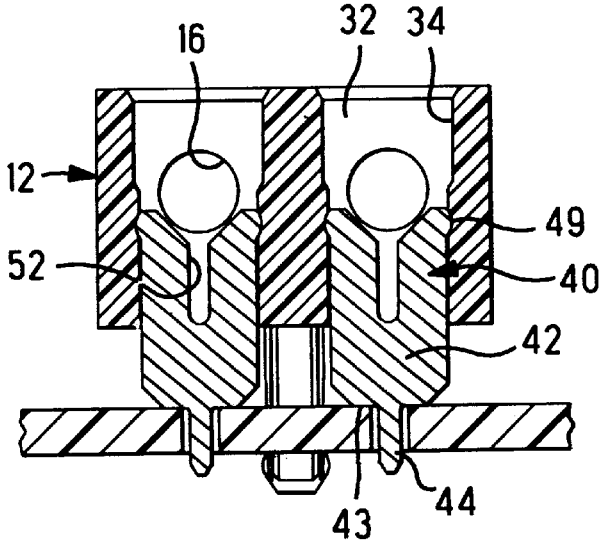
FIG. 6 is a cross-sectional view of the connector of FIG. 5.

As can be seen in FIG. 5, the alignment posts 26 and the board locking post 28 extend below the first connecting or board mounting sections 44 of the terminals 40. When mounting connector 10 to a circuit board 60, the alignment posts 26 and the board mounting post 28 can be positioned with the corresponding apertures 64, 66 of the circuit board to assure proper alignment of the connector 10 prior to inserting the terminals 40. This assures that the board mounting sections 44 are not damaged when mounting connector 10 to the circuit board. It is to be understood that the alignment posts 26 need not be included on the mounting face. The board locking post 28 provides sufficient force to hold the connector 10 to the board 60. Alignment posts, however, are desirable when the terminals are surface mountable to assure proper positioning of the board mounting portions.

Figure 7:
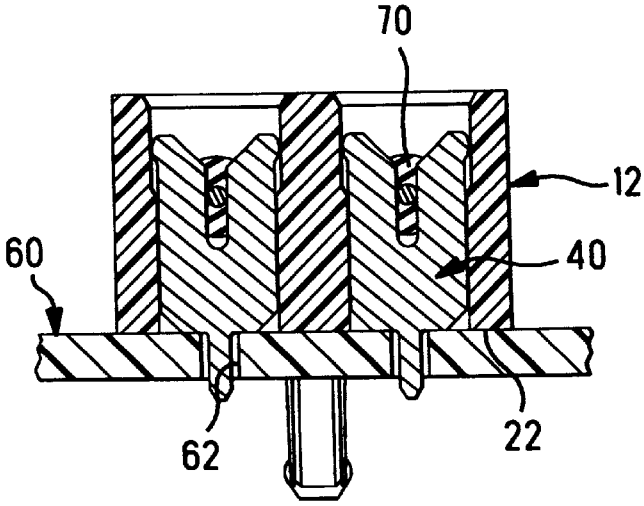
FIG. 7 is view similar to FIG. 6 after the terminals have been terminated to the wires by moving the connector housing to the second position.

Upon mounting the connector 10 to the circuit board 60 the alignment post and board lock post are partially inserted into the respective apertures 64, 66 such that the bottom edge 43 of the terminal bodies 42 rest against the upper surface of the circuit board 60. The housing 10 is still in its first position such that the terminals 40 can be secured to the circuit board 60 by wave soldering or similar techniques as known in the art. The housing 12 remains spaced from the board 60 a sufficient distance to avoid damage thereto by the heat during the wave soldering process. After the first connecting sections 44 of terminals 40 have been secured in the respective through-holes 62 the insulated conductors 70 can be inserted into the conductor-receiving apertures 16 with the ends thereof extending through the IDC slot 52. The conductors 70 are moved into an electrical engagement with the terminals 40 by applying pressure to the upper surface 20 of the housing 12 and moving the housing 12 toward the board 60 until the board mounting face 16 of the housing 12 touches the board 60, at which time the conductors 70 will be terminated to the terminals 40 as best seen in FIG. 7.

Figure 8:
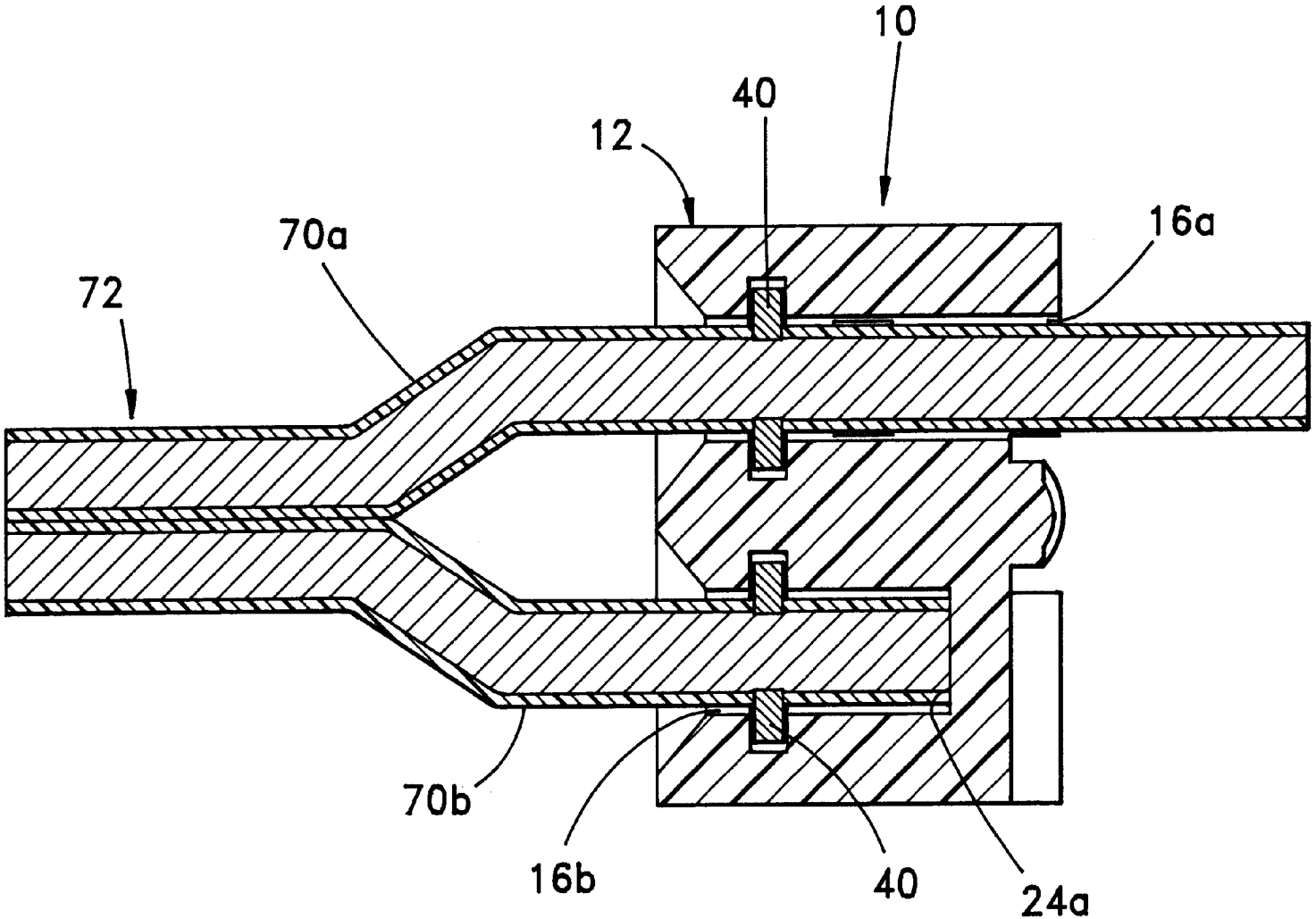
FIG. 8 is a sectional view of the connector taken along line 8—8 of FIG. 1.

In some instances the circuitry of the electronic apparatus requires that electrical connections thereto be polarized. FIG. 8 shows a sectional view of the housing 12 that illustrates the polarization capability of the connector 10 of the present invention. As shown in this figure, one of the conductor-receiving apertures 16*a* is longer than the other aperture 16*b* and, in the embodiment shown, actually extends through the housing 12. FIG. 8 further shows an electrical cable 72 having two insulated conductors 70*a* and 70*b* that are split apart at leading ends thereof, each conductor being terminated to a respective terminal 40. One of the conductors 70*b* has been trimmed to a shorter length. Upon inserting the leading ends of conductors 70*a* and 70*b* into the respective conductor-receiving apertures 16*a* and 16*b*, the longer conductor 70*a* extends through the housing 12 and the leading end of conductor 16*b* abuts a wall surface 24*a*. If, on the other hand, conductor 70*a* were to be inserted in aperture 16*b*, the leading end would abut wall 24*a* and prevent insertion of conductor 70*b* into aperture 16*a*.

It is to be understood that the passageway 16*a* need not extend completely through the housing, nor that conductor 70*a* extend through and rearwardly from the housing 12. To provide polarization, it is only necessary that longer conductor 70*a* extend beyond shorter conductor 70*b* by a length that is substantially equal to the depth of the shorter of the two conductor-receiving passageways. It is to be further understood that the invention may be used in situations requiring polarization as well as those not requiring polarization.

The present invention provides an electrical connector comprising a single piece housing and one or more IDC terminals. The connector eliminates the need to individually strip ends of wires of conductors and hand solder them to a circuit board. The connector of the present invention provides a more cost effective manufacturing process, which requires less labor and increases reliability of the resulting electrical connections. Additionally the connector provides for polarization of the connection, if desired.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical connector mounted to a circuit board comprising:

a housing having at least one conductor-receiving aperture extending thereinto from a conductor-receiving face and an associated terminal-receiving passageway extending thereinto from a board mounting face and intersecting each said conductor-receiving aperture; and a terminal disposed in each said terminal-receiving passageway, each said terminal including a body portion having a first connecting portion extending from one end thereof and electrically connected to a circuit of a circuit board and a pair of upstanding arms defining an insulation displacement contact (IDC) at an opposite end thereof for terminating an insulated conductor upon receipt thereof into an IDC slot between said arms;

each said terminal being partially inserted into said housing in a first position such that a portion of said terminal body portion and said first connecting portion extend below said board mounting face of said housing, such that an end of an insulated conductor can be inserted into a respective said conductor-receiving aperture and terminated therein to a respective said terminal by moving said housing toward the board to a second position against the board and simultaneously pushing said insulated conductor into said respective IDC slot, whereby said conductor is electrically connected to said circuit of said board without the use of solder.

2. A. The electrical connector of claim 1 wherein each said terminal is held in said first position by an interference fit between said terminal body portion and said associated terminal-receiving passageway.

3. The electrical connector of claim 1 wherein each said terminal is terminated to an associated said conductor and the connector housing is in said second position.

4. The electrical connector of claim 1 wherein said housing further includes a board mounting-locking post extending from said board mounting face that holds said connector to said circuit board in its first position by means of an interference fit in a cooperating aperture of said board.

5. The electrical connector of claim 4 wherein said board mounting-locking post extends through said cooperating board aperture and a portion of said post locks under said board when said housing is moved to said second position.

6. The electrical connector of claim 1 wherein said first connecting portion of said terminal is an elongate portion that is inserted into a corresponding through hole of the circuit board.

7. The connector of claim 6 wherein said housing further includes at least one alignment post that extends from the board mounting face beyond the first connecting portion of each said terminal such that the housing can be aligned prior to inserting each first connecting portion of each said terminal into said corresponding through-hole of said board.

8. An electrical connector mounted to a circuit board comprising:

a housing having two conductor-receiving apertures extending thereinto from a conductor-receiving face and two terminal-receiving passageways extending thereinto from a board mounting face, each passageway being associated with and intersecting one of said two conductor-receiving apertures, and a terminal disposed in each said terminal-receiving passageway, each said terminal including a body portion having a first connecting portion extending from one end thereof and electrically connected to a circuit of a circuit board and a pair of upstanding arms defining an insulation displacement contact (IDC) at an opposite end thereof for terminating an insulated conductor upon receipt thereof into an IDC slot between said arms;

each said terminals being partially inserted into said housing in a first position such that a portion of said terminal body and said first connecting portion extend below said board mounting face of said housing, such that an end of each of two insulated conductors can be inserted into a respective one of said conductor-receiving apertures and terminated therein to a respective said terminal by moving said housing toward the board to a second position against the board and simultaneously pushing said insulated conductors into respective said IDC slots, whereby said conductors are electrically connected to an associated circuit of said board without the use of solder.

9. The electrical connector of claim 8 wherein one of said two conductor-receiving apertures is longer than the other of said apertures such that a cable having two insulated conductors with one conductor being longer than the other can be inserted into said conductor-receiving apertures in only one orientation thereby defining a polarized connection.

10. The electrical connector of claim 8 wherein each said terminal is held in said first position by an interference fit between said terminal body portion and said associated terminal-receiving passageway.

11. The electrical connector of claim 8 wherein each said terminal is terminated to an associated said insulated conductor and the connector housing is in said second position.

12. The electrical connector of claim 8 wherein said housing further includes a board mounting-locking post extending from said board mounting face that holds said connector to said circuit board in its first position by means of an interference fit in a cooperating aperture of said board.

13. The electrical connector of claim 12 wherein said board mounting-locking post extends through said cooperating board aperture and a portion of said post locks under said board when said housing is moved to said second position.

14. The electrical connector of claim 8 wherein said first connecting portion of each said terminal is an elongate portion that is inserted into a corresponding through hole of the circuit board.

15. The connector of claim 14 wherein said housing further includes at least one alignment post that extends from the board mounting face beyond the first connecting portion of each said terminal such that the housing can be aligned prior to inserting said first connecting portion of each said terminal into said corresponding through-hole of said board.

16. A method of terminating conductors of an insulated cable to respective circuits of a circuit board comprising the steps of:

providing a housing having a conductor-receiving aperture for each conductor of said cable, each said aperture extending thereinto from a conductor-receiving face and an associated terminal-receiving passageway extending thereinto from a board mounting face and intersecting each said conductor-receiving aperture;

disposing a terminal in each said terminal-receiving passageway, each said terminal including a body portion having a first connecting portion extending from one end thereof and a pair of upstanding arms defining an insulation displacement contact (IDC) at an opposite end thereof for terminating an insulated conductor upon receipt thereof into an IDC slot between said arms;

partially inserting each said terminal into said housing in a first position such that a portion of said terminal body portion and said first connecting portion extend below said board mounting face of said housing;

electrically connecting said first connecting portion of each said terminal to the respective circuit of the circuit board;

inserting an end of an insulated conductor into a respective said conductor-receiving aperture; and moving said housing toward the board to a second position against the board and simultaneously pushing each said insulated conductor into said respective IDC slot, thereby electrically connecting each conductor to the respective circuit of the circuit board.

* * * * *